US005692319A

United States Patent [19]

Parker et al.

[11] Patent Number: 5,692,319

[45] Date of Patent: Dec. 2, 1997

[54] ARTICLE OF FOOTWEAR WITH 360° WRAP FIT CLOSURE SYSTEM

[75] Inventors: Mark G. Parker, Portland; Allen W. Van Noy; Stephen M. Vincent, both of Beaverton, all of Oreg.

[73] Assignee: Nike, Inc., Beaverton, Oreg.

[21] Appl. No.: 472,292

[22] Filed: Jun. 7, 1995

[51] Int. Cl.[6] ..... A43C 11/00; A43B 7/20; A43B 5/00

[52] U.S. Cl. ..... 36/50.1; 36/89; 36/114

[58] Field of Search ..... 36/50.1, 115, 117.3, 36/89, 91, 103, 31, 145, 173, 170, 114, 76 R, 93

[56] References Cited

U.S. PATENT DOCUMENTS

| | | | |
|---|---|---|---|
| 430,982 | 6/1890 | Ziegler . | |
| 459,616 | 9/1891 | Von Rohonczy | 36/89 |
| 702,476 | 6/1902 | Price | 36/136 X |
| 703,828 | 7/1902 | Read | 36/89 |
| 950,862 | 3/1910 | Nelson . | |
| 1,089,073 | 3/1914 | Palmer . | |
| 1,110,362 | 9/1914 | Whitaker . | |
| 1,155,506 | 10/1915 | Osaki . | |
| 1,252,149 | 1/1918 | Muse . | |
| 1,283,335 | 10/1918 | Shillcock . | |
| 1,462,534 | 7/1923 | Condylis et al. . | |
| 1,546,551 | 7/1925 | Petri . | |
| 1,655,715 | 1/1928 | Sneeston . | |
| 1,944,664 | 1/1934 | Maxcy . | |
| 2,147,197 | 2/1939 | Glidden . | |
| 2,233,544 | 3/1941 | McKinley . | |
| 2,421,818 | 6/1947 | Tibiletti . | |
| 2,446,902 | 8/1948 | Brand . | |
| 2,592,739 | 4/1952 | Richardson . | |
| 2,642,677 | 6/1953 | Yates . | |
| 2,660,813 | 12/1953 | Shapiro . | |
| 2,708,930 | 5/1955 | Lowman . | |
| 2,741,039 | 4/1956 | Mathews . | |
| 2,935,798 | 5/1960 | Piberhofer . | |
| 3,047,967 | 8/1962 | Hoyt et al. . | |
| 3,086,521 | 4/1963 | Desai et al. | 602/27 X |
| 3,138,880 | 6/1964 | Kunzli . | |
| 3,464,125 | 9/1969 | Conway . | |
| 3,506,000 | 4/1970 | Baker . | |
| 3,618,598 | 11/1971 | Davis | 128/85 |
| 3,699,959 | 10/1972 | Garrahan et al. | 128/166 |

(List continued on next page.)

FOREIGN PATENT DOCUMENTS

| | | | |
|---|---|---|---|
| 21218/29 | 7/1929 | Australia . | |
| 0 057 170 | 8/1982 | European Pat. Off. . | |
| 11075 | 9/1895 | Switzerland | 36/170 |
| 5832 | of 1905 | United Kingdom . | |
| 4364 | 1/1916 | United Kingdom . | |
| 160318 | 3/1921 | United Kingdom | 36/170 |
| 358597 | 7/1930 | United Kingdom . | |
| 424545 | 8/1934 | United Kingdom . | |
| 527235 | 10/1940 | United Kingdom | 36/170 |
| 2162043 | 1/1986 | United Kingdom . | |
| 9004933 | 5/1990 | WIPO | 36/89 |

OTHER PUBLICATIONS

Lotto "B1 Project" Brochure, Lotto S.p.A., Montebelluna, Italy, Aug. 1995.

*Primary Examiner*—B. Dayoan
*Attorney, Agent, or Firm*—Banner & Witcoff, Ltd.

[57] ABSTRACT

An article of footwear includes a shoe sole, a shoe upper having medial and lateral sides, and a closure element which overlaps the shoe upper and has a plurality of fastening projections. The closure element extends upwards along each side of the shoe upper as well as beneath the shoe sole. Each of the fastening projections includes an aperture or loop for receiving a shoe lace such that the projections on opposing sides of the shoe upper are connected together by the shoe lace and the shoe upper is thereby secured around the foot of the wearer. The closure element may be permanently attached to the article of footwear, or it may be removably disposed thereover. The tongue of the shoe upper may also include a positioning element for positioning the shoe lace between opposing sides of the fastening projections.

24 Claims, 8 Drawing Sheets

U.S. PATENT DOCUMENTS

| | | | |
|---|---|---|---|
| 3,777,751 | 12/1973 | Wise | 128/166 |
| 4,144,881 | 3/1979 | Chappell | 128/80 R |
| 4,200,997 | 5/1980 | Scheinhaus et al. | 36/11.5 |
| 4,236,328 | 12/1980 | Friedlander | 128/166 X |
| 4,245,408 | 1/1981 | Larsen et al. | 36/50.1 |
| 4,268,981 | 5/1981 | Olivieri | 36/115 |
| 4,270,285 | 6/1981 | Antonious | 36/50.1 |
| 4,282,657 | 8/1981 | Antonious | 36/50.1 |
| 4,308,672 | 1/1982 | Antonious | 36/50.1 |
| 4,313,433 | 2/1982 | Cramer | 128/166 X |
| 4,314,412 | 2/1982 | Anderson et al. | 36/100 |
| 4,342,161 | 8/1982 | Schmohl | 36/50.1 X |
| 4,351,537 | 9/1982 | Seidel | 36/115 X |
| 4,366,631 | 1/1983 | Larsen et al. | 36/50.1 |
| 4,392,487 | 7/1983 | Selner et al. | 128/166 |
| 4,411,077 | 10/1983 | Slavitt | 36/89 |
| 4,459,980 | 7/1984 | Perser et al. | 128/80 E |
| 4,461,288 | 7/1984 | Curtis | 128/166 X |
| 4,476,639 | 10/1984 | Zaccaria | 36/114 |
| 4,542,598 | 9/1985 | Misevich et al. | 36/114 |
| 4,597,395 | 7/1986 | Barlow et al. | 128/166 X |
| 4,649,939 | 3/1987 | Curtis | 36/89 X |
| 4,670,998 | 6/1987 | Pasternak | 36/114 |
| 4,766,682 | 8/1988 | Malloy, III | 36/50.1 X |
| 4,947,560 | 8/1990 | Fuerst et al. | 36/88 |
| 4,972,609 | 11/1990 | Oh et al. | 36/50.1 X |
| 5,184,378 | 2/1993 | Batra | 36/50.1 X |
| 5,377,430 | 1/1995 | Hatfield et al. | 36/51 |
| 5,497,564 | 3/1996 | Auen et al. | 36/50.1 |
| 5,498,033 | 3/1996 | Hoshizaki et al. | 36/115 X |

ARTICLE OF FOOTWEAR WITH 360° WRAP FIT CLOSURE SYSTEM

TECHNICAL FIELD

The present invention is directed to a shoe with an improved wrap closure and fit system, and in particular, a system including members that encircle the sole or attach to the sole such that tension in the members is distributed around the shoe upper and thereby conforms the shoe upper and midsole to the shape of the foot.

BACKGROUND OF THE INVENTION

Numerous closure systems are known in the prior art for securing or fitting an article of footwear to a foot. The most common and relatively simple technique is the use of a lacing system. In the simplest form of a lacing system, the upper is split down its middle bisecting the area above the instep, and eyelets are located along either side of the split. A lace is passed through the eyelets and crisscrossed across the split from the bottom of the split to the top of the split. By pulling on the upper free ends of the lace, the split portions of the upper are drawn toward one another and the shoe is tightened around the foot.

There are many variations to this basic form of lacing system. For example, the eyelets may be located at various widths across the split in the upper such as shown in U.S. Pat. No. 4,255,876 to Johnson, or the use of speed laces in combination with a variable width lacing such as disclosed in U.S. Pat. No. 4,553,342 to Derderian et at.

The use of straps in shoe lacing systems is also known in the art. Straps have been used in shoes as a replacement for conventional laces, or as an adjunct to a lacing system. U.S. Pat. No. 4,486,965 to Friton is an example of the use of straps as a replacement for conventional laces. In this patent, straps are formed as an integral extension of the upper material and include hook and pile fasteners on the outer surface of the shoe upper. In U.S. Pat. No. 4,476,639 to Zaccaria, a laceless shoe is disclosed with an adjustable strap fastening system. The pull strap encircles the foot by passing from beneath the foot, over the instep, across the dorsum of the foot, through the structure of the shoe beneath the foot, and then fastening across the upper. A channel entry opening and a channel exit opening are provided in the insole and the upper layer of the outer sole for passage of the pull strap therethrough.

Shoes including the use of straps as part of the lacing system are also known in the art, such as in U.S. Pat. No. 2,147,197 to Glidden, where, in one embodiment of the invention, straps extend upward from the sole over an elastic upper and have eyelets on their upper ends. In U.S. Pat. No. 1,283,335 to Shillcock, an article of footwear is disclosed having leather side extensions integrally formed with the leather sole. The side extensions are drawn up and secured around the instep of the foot and the ankle as well, if desired, to retain the footwear tightly to the foot in combination with conventional lacing.

The closure systems discussed above do not offer a suitable amount of fit adjustment when securing an article of footwear to a foot to take into consideration the different anatomical features of an individual wearer and the degree of support required by the article of footwear.

SUMMARY OF THE INVENTION

The present invention overcomes the disadvantages of the prior art by providing an article of footwear having a 360° wrap closure system that distributes the tension in the closure system around the periphery of the foot of the wearer and thereby anatomically conforms the shoe midsole and upper to the foot.

The article of footwear includes a shoe sole, a shoe upper having medial and lateral sides, and a closure element which overlaps the shoe upper and has a plurality of fastening projections. The closure element extends upwards along each side of the shoe upper as well as beneath the shoe sole. Preferably, each of the fastening projections includes an aperture or loop for receiving a shoe lace such that the fastening projections on opposing sides of the shoe upper are connected together by the shoe lace and the shoe upper is thereby secured around the foot of the wearer. The closure element may further include a heel strap that extends around the heel region of the shoe upper.

In accordance with the present invention, the closure element may be permanently attached to the article of footwear, or it may be removably disposed thereover. To removably secure the closure element to the article of footwear, the bottom portion of the lacing element includes an opening and the shoe sole includes a securing element projecting from beneath the shoe sole. The opening and the securing element generally correspond in size and shape such that the opening in the bottom portion may be removably secured over the securing element on the shoe sole.

The advantages of using an integral base with plural projections include the reduction of weight gained by thinning down the midsole walls. Thinner midsole walls should enable the plural projections to conform more closely to the individual foot shape. A second advantage is the enhanced ability of the article of footwear to adjust and fit a wider variety of foot shapes. Also, the integral base and plural projections increase the overall stability and control of the article of footwear by providing a more stable platform for the foot.

In a further embodiment of the invention, the article of footwear includes a tongue disposed between the medial and lateral sides in order to define an opening for receiving the foot of the wearer. The tongue includes a positioning element for positioning the shoe lace between opposing sides of the fastening projections. The positioning element includes a plurality of lace passageways spaced along the length of the tongue such that the shoe lace passes through the lace passageways as the shoe lace connects the apertures or loops of the fastening projections on opposing sides of the shoe upper.

This lace guiding system provides a means of ensuring that the plural projections will maintain the proper alignment on the foot in order to conform more closely to the individual foot shape. The lace guiding system also prevents excessive movement of the tongue which could cause discomfort to the wearer.

BRIEF DESCRIPTION OF THE DRAWINGS

The above description and other objects, advantages, and features of the present invention will be more fully understood and appreciated by reference to the specification and accompanying drawings, wherein.

DETAILED DESCRIPTION OF THE PREFERRED EMBODIMENTS

Figure 1:
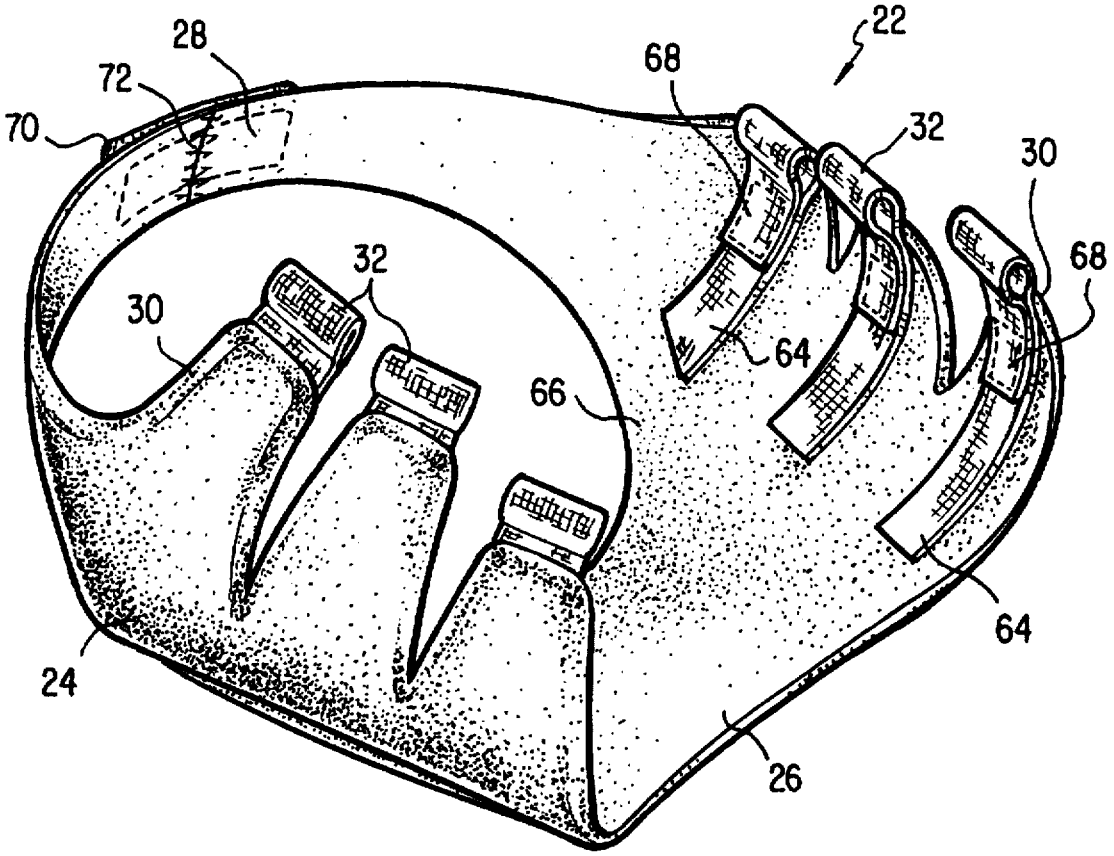
FIG. 1 is a perspective view of an encircling closure system in accordance with a first embodiment of the present invention.

With reference to FIGS. 1–4, an article of footwear having a closure and fitting system in accordance with the present invention is illustrated. The article of footwear 100 includes a sole 10, which may further include an outsole 12 and a midsole 14. Upper 16 is secured to the upper surface of sole 10 and may include a toe reinforcement section or tip 18 and a main enclosure or sleeve 20 into which a foot of the wearer is inserted. Article of footwear 100 further includes an encircling closure and fitting system 22, which is most clearly shown in FIG. 1. Closure system 22 is disposed around the instep area of article of footwear 100. The closure and fitting system 22 shown in FIG. 1 is slightly different from that shown in FIGS. 2–4. However, the two systems may be considered to disclose a similar inventive concept in accordance with the present invention.

As shown most clearly in FIG. 1, closure and fitting system 22 includes a body portion 24 overlapping the shoe upper 16, a sole wrap or base portion 26 extending generally beneath the outsole 12, and, in a preferred embodiment, a heel portion 28 extending around the heel of the upper 16 and joining together opposing sides of body portion 24. Heel portion 28 extends around from each side of body portion 24 and is joined at the rear of upper 16 by stitching or any other conventional means. As shown in FIG. 1, a reinforcement tab 70 may be disposed over the joining seam 72 of heel portion 28 to further protect and strengthen the stitched seam 72. Reinforcement tab 70 may similarly be attached by stitching or other conventional means. Body portion 24 includes a plurality of separated, finger-like projections 30 extending upward and across the instep area of the shoe upper. The upper edge 27 of heel portion 28 is integral with the rearmost edge of the rearmost projection. The lower edge 29 of heel portion 28 is integral with the rearmost edge of body portion 24 and may extend downwardly toward sole wrap portion 26. The FIG. 1 embodiment uses three projections 30, while the FIG. 2 embodiment uses four projections 30. Any suitable number of projections can be used as long as the functions of the projections are accomplished. For example, sufficient projections are needed to provide adequate lacing locations to secure the lace over the instep, while also transmitting a tightening force to sole wrap portion 26. In order to provide sufficient support and strength to the mid-foot area, as discussed below, body portion 24 is preferably formed from a material such as rubber, textiles, composites, thermoplastics, nonwoven materials and meshes, leather and combinations thereof.

Body portion also includes a plurality of lace loops or lace apertures 32 disposed at the uppermost edge of projections 30. The lace loops 32 shown in FIG. 1 are formed by attaching a first end 64 of the lace loop material to an inner surface 66 of body portion 24. The lace loop material is then folded over to form loops 32 extending above projections 30 and the second end 68 of the lace loop material is then also attached to inner surface 66. Second end 68 may be secured by stitching over top of first end 64 to inner surface 66. Additional stitching may also be used to further define the width and shape of lace loop 32. The lace loop material is a durable material capable of holding the loop shape, such as nylon flat webbing, perlon, and the like.

Figure 2:
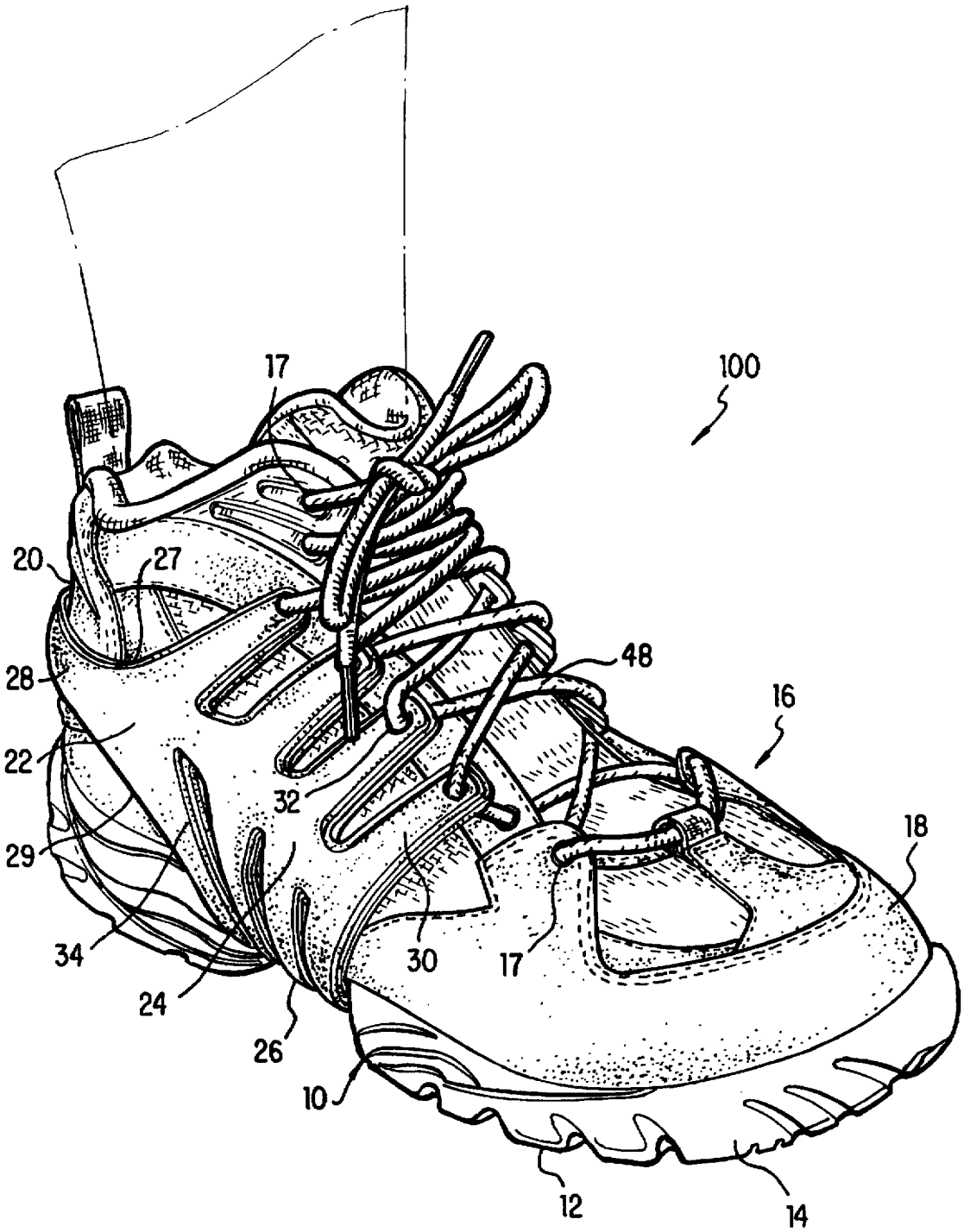
FIG. 2 is a top perspective view of a second encircling closure system utilized in combination with the fastening system of an article of footwear.
Figure 3:
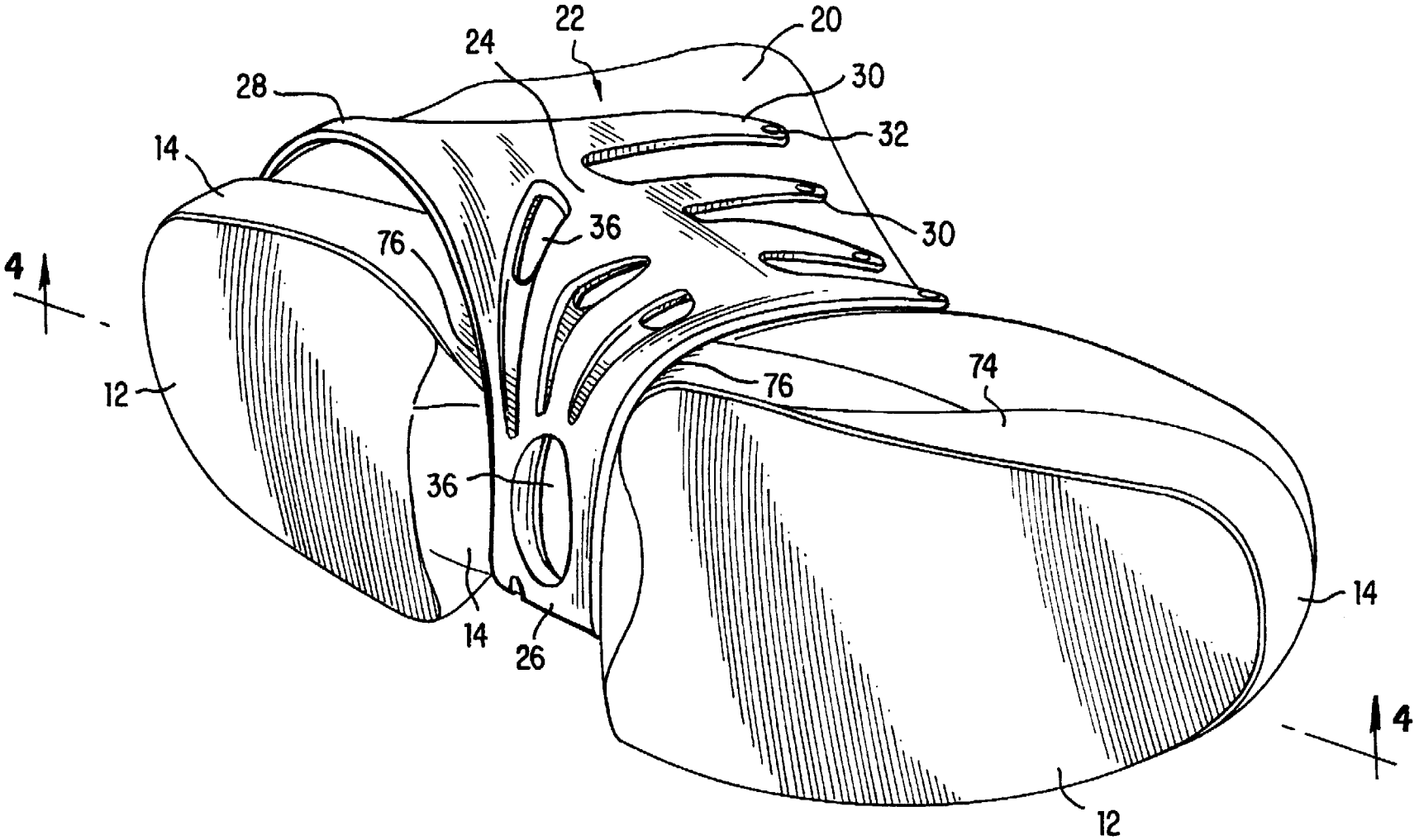
FIG. 3 is a bottom perspective view of the closure system shown in FIG. 2.
Figure 4:
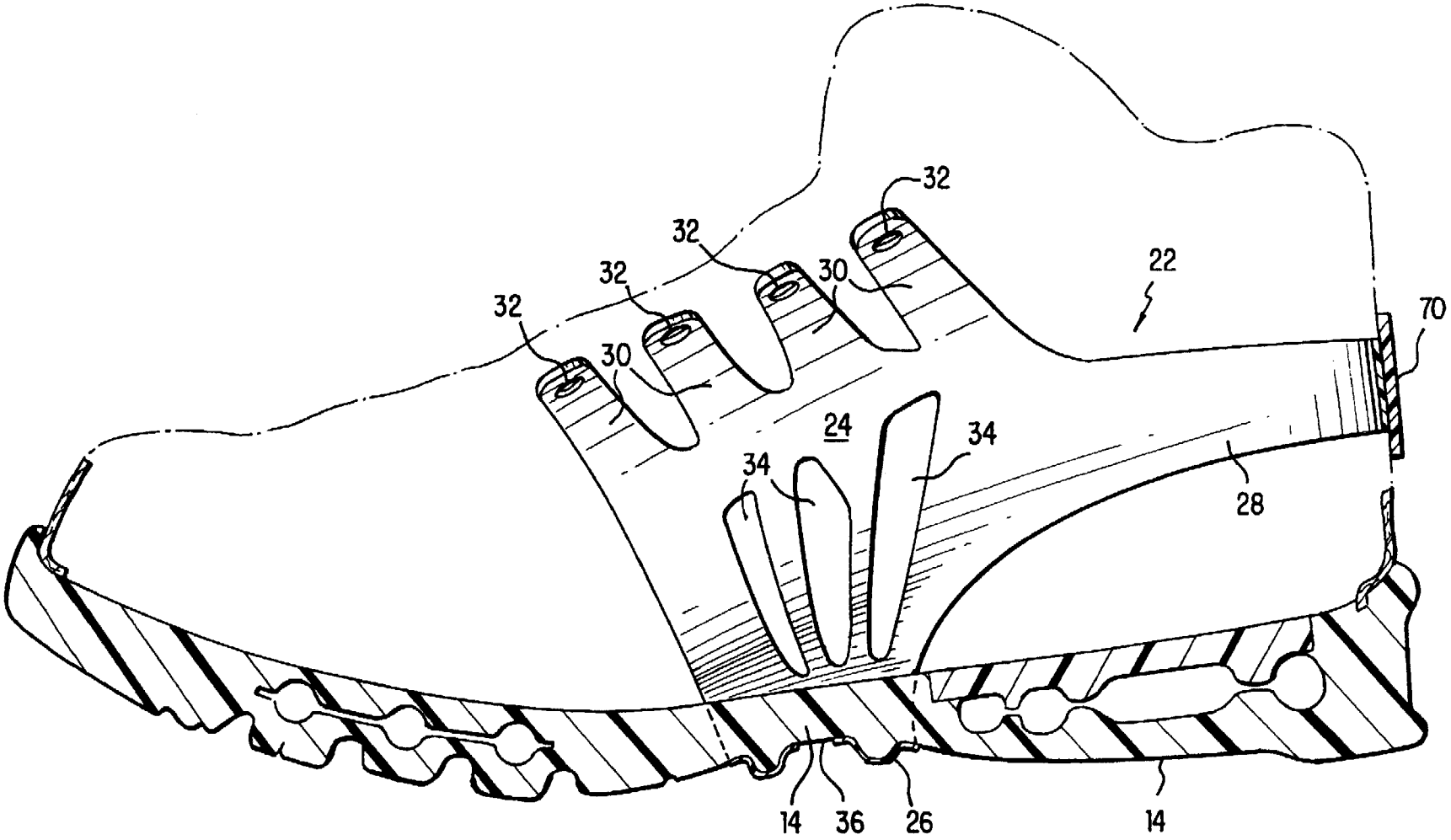
FIG. 4 is a cross-sectional view taken generally along the line 4—4 of FIG. 3.
Figure 5:
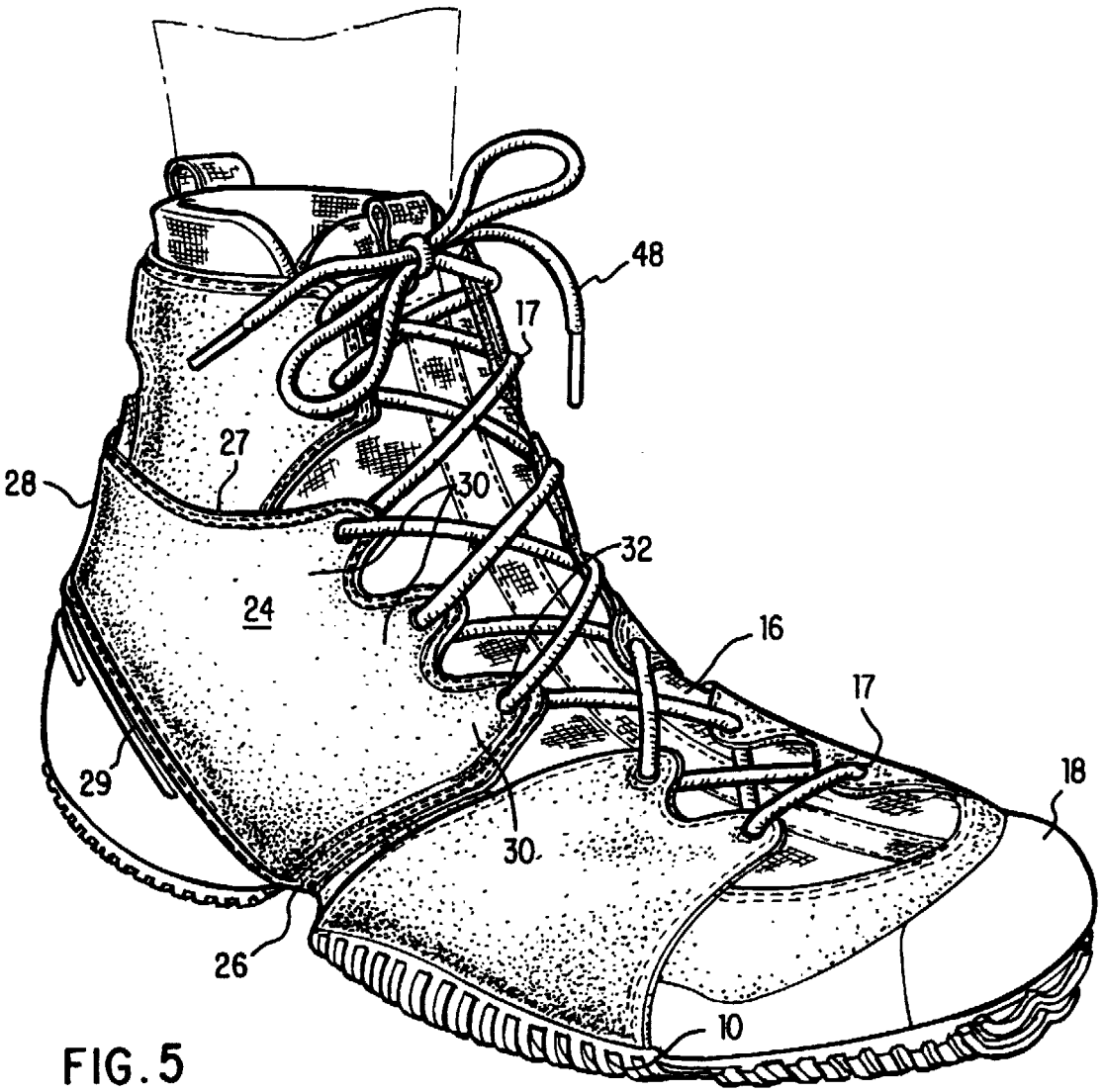
FIG. 5 is a top perspective view of an encircling closure system in accordance with a still further embodiment of the present invention.
Figure 6:
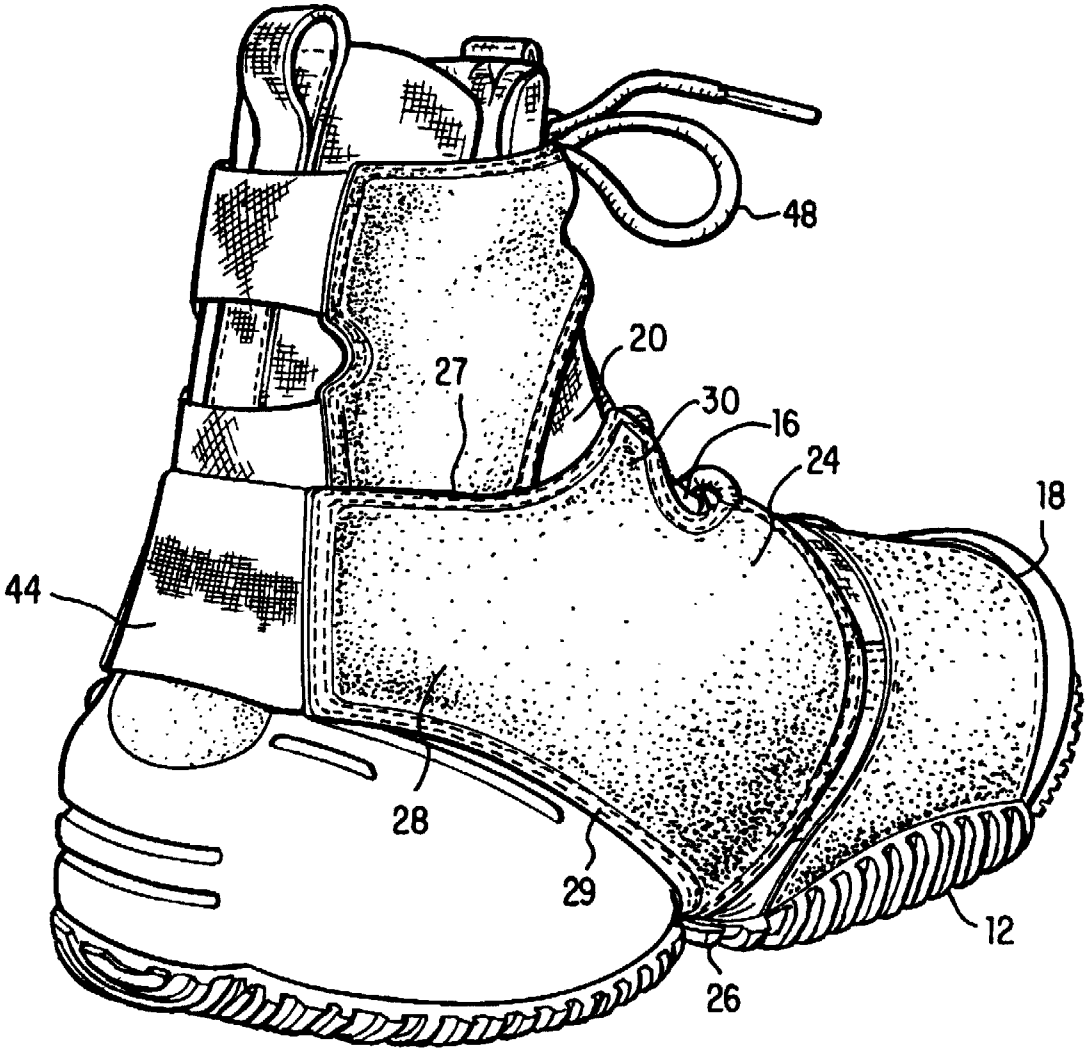
FIG. 6 is a rear view of the closure system shown in FIG. 5.

As shown in FIGS. 2–4, closure system 22 can also include a plurality of reinforced lace apertures 32 extending through the uppermost portion of the separated projections 30, rather than the lace loops shown in FIG. 1. Projections 30 can also support other types of fastening devices such as buckles and hook and pile fasteners. In the illustrated embodiment of FIGS. 2–4, body portion 24 of closure system 22 further includes a plurality of cutout regions 34 in the sides thereof and a further cutout region 36 in the sole wrap portion 26 extending beneath the sole 10. As shown in FIG. 4, the sole wrap portion 26 is immediately adjacent to sole 10 and the cutout region 36 may therefore expose a region of the outsole or mid sole therebeneath. In a preferred embodiment of the invention, the sides 74 of midsole 14 include contours or grooves 76 which conform to and receive the sole wrap portion 36 therearound. The midsole material 14 may be thinner in the region of these contours 76 and the outsole 12 may be completely removed from the wrap area such that a closer anatomical fit is obtained between the closure system 22, the shoe upper 16, and the foot of the wearer. Closure system 22 may be attached to sole 10 at sole wrap portion 26 by adhesive, stitching or any other conventional means. Alternatively, closure system 22 may not be permanently attached to sole 10 at all, as discussed below.

FIGS. 5–8 illustrate yet another embodiment of the present invention. In this embodiment, projections 30 are formed as small extensions of body portion 24, rather than the finger-like projections of the previous embodiments. Each projection 30, nevertheless, includes a lace aperture 32 at the outermost region thereof. In addition, an elastic connection member 44 is utilized to connect opposing sides of heel portion 28 around the back of the heel. Closure system 22, according to the embodiment of FIGS. 5-8, is not permanently attached to sole 10 and may be completely removed from article of footwear 100.

Figure 7:
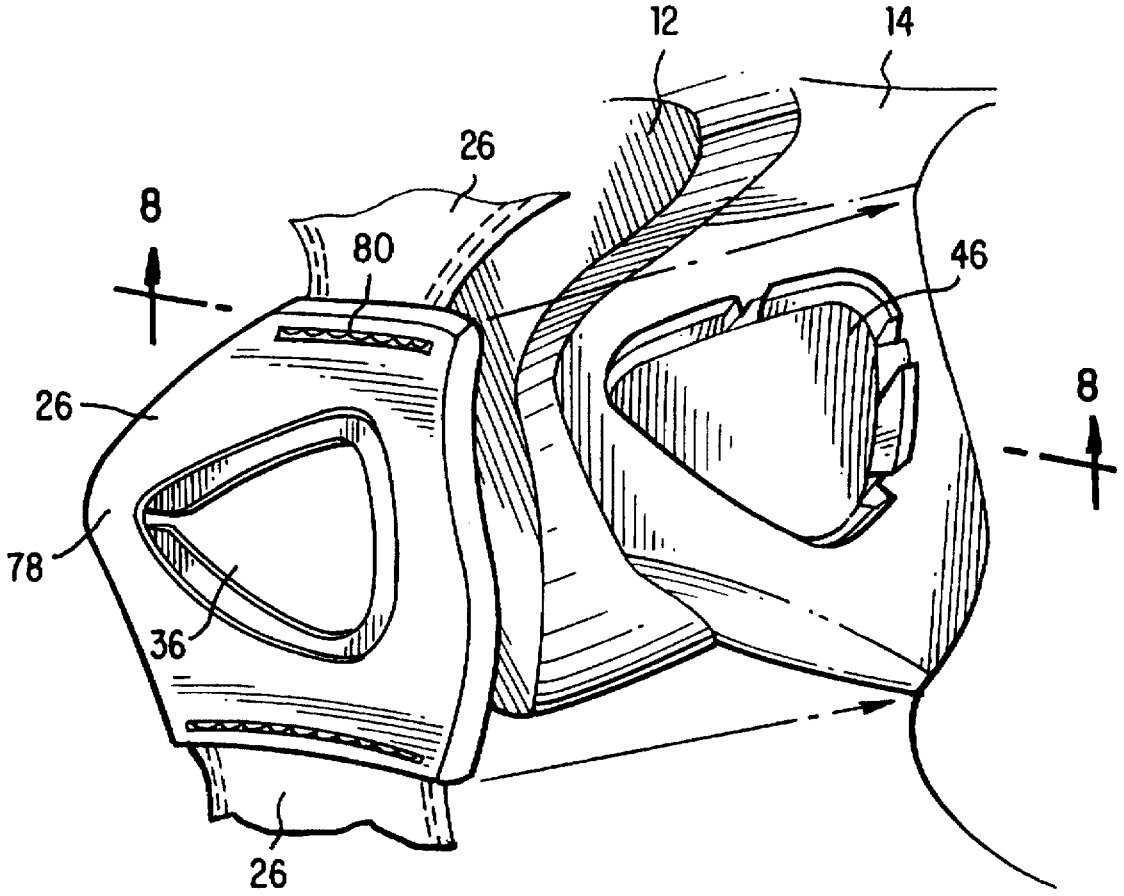
FIG. 7 is an enlarged, partial bottom view of the closure system shown in FIG. 5.
Figure 8:
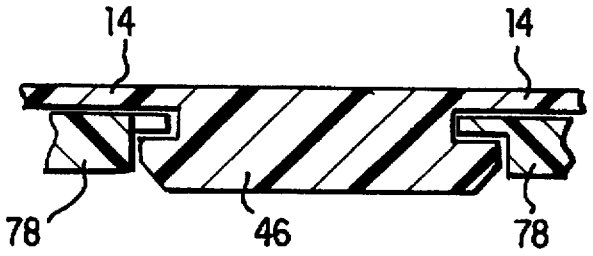
FIG. 8 is a cross-sectional view taken generally along the line 8—8 of FIG. 7.

Referring to FIGS. 7 and 8, it is shown that sole wrap portion 26 includes a cutout region 36 that is generally triangular in shape. Sole 10 likewise includes a securing member 46 which is generally triangular in shape. Thus, cutout region 36 may be removably secured or snapped into position over securing member 46 on the bottom of sole 10 to removably attach closure system 22 to the article of footwear. More specifically, sole wrap portion 26 has a connecting element 78 which includes cutout region 36. Connecting element 78 is disposed on the bottom of the article of footwear. Connecting element 78 is preferably formed from a durable and stiff material, such as rubber, textiles, composites, thermoplastics, nonwoven meshes, leather and combinations thereof. Connecting element 78 is joined to opposing sides of sole wrap portion 26 by stitching or any other conventional fastening means. Preferably, securing member 46 extends from midsole 14, with a portion of outsole 12 and/or midsole 14 having been removed to accommodate the thickness of connecting element 78 after it is disposed over securing element 46. Although illustrated as a generally triangular element, securing member 46 and the corresponding cutout region 36 within the connecting element of closure system may, of course, be any desired configuration.

In each of the above-described embodiments, closure system 22 is utilized to provide a wrap closure system for the article of footwear. As illustrated, a shoe lace 48 or a similar lacing device extends through the lace loops or lace apertures 32 on opposing sides of shoe upper 16. When drawn together therefore, the tension in closure system 22 and the tension around the foot of the wearer is thereby increased. Closure system 22 allows this increased tension to be distributed not only to the lace apertures, but to the sides of the shoe upper and, preferably, around the bottom of the shoe sole as well. That is, the projections 30 of body portion 24 are tensioned around the shoe upper to conform the main enclosure or sleeve 20 to the foot of the wearer. Similarly, sole wrap portion 26 is tensioned around the shoe sole to conform the midsole 14 to the foot of the wearer, particularly when midsole 14 includes the thinner contours 76 below the sole wrap portion 26. Thus, the present invention provides a tensioned closure three hundred and sixty degrees around the periphery of the foot of the wearer as wrap closure system 22 anatomically molds the upper and midsole thereto.

Figure 9:
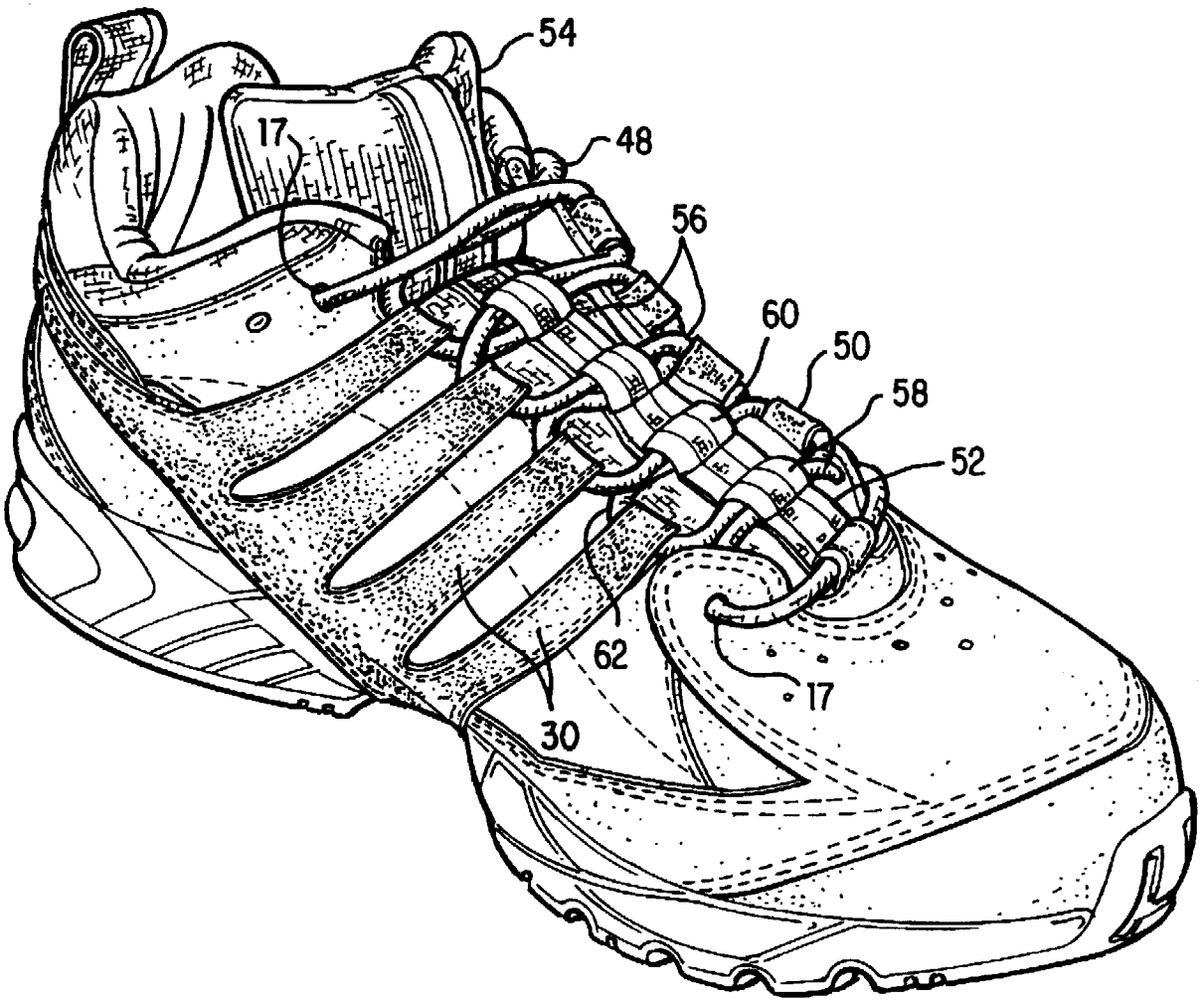
FIG. 9 is a perspective view of a lacing system in accordance with the present invention.

Referring to FIG. 9, a further lacing system is provided in accordance with the present invention. Lacing system 50 may be utilized with closure system 22 as illustrated or on any article of footwear having separate projections with lace loops or apertures for the passage of a shoe lace. Lacing system 50 includes a central elongate element 52 disposed on the upper surface of the tongue 54. Elongate element 52 is secured to tongue 54 at a plurality of spaced locations 56 and thereby defines a plurality of passageways or tunnels 58 between the secured locations 56. Passageways 58 are defined in one embodiment between the surfaces of tongue 54 and elongate element 52. In a further preferred embodiment of the invention, elongate element 52 includes an upper layer 60 and a lower layer 62. In this embodiment, lower layer 62 is permanently secured to tongue 54 along its entire length and only upper layer 60 is secured at the secured locations 56. Thus, passageways or tunnels 58 are defined between the upper and lower layers 60, 62 of the elongate element 52. In a preferred embodiment, secured locations 56 are secured to tongue 54 by stitching lines. Other methods of attaching the elongate element 52 to tongue 54 may, of course, also be utilized.

Preferably, the secured locations 56 are generally aligned with separated projections 30 and tunnels 58 are thereby properly aligned to receive the lace extending through the apertures of projections 30. In a preferred embodiment, shoe lace 48 extends through apertures 17 in shoe upper 16 located at the base of the tongue 54, then through the apertures or lace loops 32 of closure system 22, and finally, again through at least one aperture 17 on shoe upper 16. Thus, in lacing system 50, shoe lace 48 extends through the opposing lace apertures or lace loops of the article of footwear and, when passing over tongue 54, are also inserted through the corresponding passageways 58. In this manner, shoe lace 48 is restrained from substantial movement. More particularly, however, separated projections 30 are therefore also restrained from substantial movement and maintained in the desired alignment. The restraint of projections 30 allows a closing force to be applied to the shoe lace and properly distributed around sole wrap portion 26.

In the embodiment shown in FIG. 9, lacing system 50 includes a series of four passageways 58 through which shoe lace 48 extends. The number of passageways 58 and the spacing thereof may, however, vary with the size and style of the particular article of footwear and the desired degree of lace alignment. Thus, the embodiment of FIG. 9 could include up to five or more passageways 58 or may be only two passageways 58, provided that shoe lace 48 is sufficiently restrained from substantial movement. Alternatively, a plurality of disconnected and individual passageways 58 may be similarly secured on the upper surface of the tongue in order to restrain shoe lace 48 from substantial movement.

It can be readily understood that a variety of alternate or equivalent materials and configurations could be used in the present invention. It will also be obvious to those of ordinary skill in the art that numerous modifications may be made without departing from the true spirit and scope of the present invention, which is to be limited only by the appended claims.

We claim:

1. An article of footwear comprising:

a shoe sole including a ground engaging surface;

a shoe upper attached to said shoe sole for surrounding a foot of a wearer, said shoe upper including a medial side, a lateral side and an instep area;

a closure element overlapping said shoe upper, said closure element including a lateral body portion and a medial body portion extending along the lateral side and the medial side of said shoe upper, respectively, and a base portion extending beneath said shoe sole, said lateral body portion extending upwardly from the base portion to the instep area of the shoe upper on the lateral side of the shoe upper, said medial body portion extending upwardly from the base portion to the instep area of the shoe upper on the medial side of the shoe upper;

said lateral body portion and said medial body portion of the closure element each having a plurality of separated individually-tensionable fastening projections extending upwards to the instep area of the shoe upper, each said fastening projection having a distal end located distal from base portion and proximate the instep area of said shoe upper, said fastening projections each having a lace engaging element located at or immediately adjacent its distal end;

wherein said fastening projections on opposing sides of said shoe upper are connected together by a cooperating lacing device coupled to each said lace engaging element to thereby secure said shoe upper and the closure element around the foot of the wearer.

2. The article of footwear of claim 1 wherein said closure element further includes a heel strap, said heel strap extending around a heel region of said shoe upper.

3. The article of footwear of claim 2 wherein each said plurality of fastening projections includes a rearmost located fastening projection, and wherein an upper edge of said heel strap integrally joins a rearward edge of both said rearmost fastening projections.

4. The article of footwear of claim 2 wherein a bottom edge of said heel strap integrally joins a rearward edge of each said medial and lateral body portions of said closure element.

5. The article of footwear of claim 1 wherein said closure element is removably disposed over said shoe upper.

6. The article of footwear of claim 5 wherein said base portion includes an opening, said shoe sole including a securing element projecting from beneath said shoe sole, and generally corresponding in size and shape to said opening such that said opening in said base portion may be removably secured over said securing element on said shoe sole.

7. The article of footwear of claim 1 wherein said shoe sole includes a midsole layer and an outsole layer, said midsole layer being thinner in an area corresponding to where said overlapping closure element extends along each side of said shoe upper and beneath said shoe sole.

8. The article of footwear of claim 7 wherein said outsole layer is removed from an area corresponding to where said base portion of said closure element extends beneath said shoe sole.

9. The article of footwear of claim 1 wherein said closure element is made from a non-woven material.

10. The article of footwear of claim 1 wherein said closure element includes at least three fastening projections on each of said lateral and medial body portions.

11. The article of footwear of claim 10 wherein said closure element includes at least three fastening projections on each of said lateral and medial body portions.

12. The article of footwear of claim 10 wherein said medial and lateral body portions of said closure element include a plurality of cutout regions therein disposed below said fastening projections.

13. A closure element for use with an article of footwear having a shoe sole including a ground engaging surface, a shoe upper attached to the shoe sole for surrounding a foot of a wearer, and including an instep area, a medial side and a lateral side, the closure element being removably disposed over the shoe upper; said closure element comprising:

a base component, a medial component and a lateral component for overlapping the shoe upper such that said closure element extends substantially along the medial side of the shoe upper, beneath the shoe sole, and substantially along the lateral side of the shoe upper;

a plurality of separated fastening members for extending upwards from the lateral component to the instep area of the shoe upper on the lateral side of the shoe upper and a plurality of separated fastening members for extending upwards from the medial component to the instep area of the shoe upper on the medial side of the shoe upper, each said fastening member having a distal end located distal from the base component and proximate the instep area of said shoe upper, said fastening members each having a lace engaging element located at or immediately adjacent its distal end;

wherein said fastening members on opposing sides of the shoe upper are connected together by a cooperating fastening device coupled to each said lace engaging element for securing the shoe upper and the closure element around the foot of the wearer.

14. The closure element of claim 13 wherein each said lace engaging element includes an aperture for receiving a shoe lace and said cooperating fastening device includes a shoe lace extending through said opposing apertures to thereby secure the shoe upper around the foot of the wearer.

15. The closure element of claim 13 wherein said closure element is made from a non-woven material.

16. The closure element of footwear of claim 13 wherein one of said medial and lateral components includes at least three fastening projections.

17. The closure element of footwear of claim 16 wherein both said medial and lateral components includes at least three fastening projections.

18. The closure element of claim 13 wherein said medial and lateral components of said closure element include a plurality of cutout regions therein disposed below said fastening members, and wherein said closure element is made from a non-woven material.

19. An article of footwear comprising:

a shoe sole including a ground engaging surface;

a shoe upper attached to said shoe sole for surrounding a foot of a wearer, and including an instep area, a medial side and a lateral side;

a closure element having a base component, and a medial component and a lateral component overlapping said shoe upper such that said closure element extends substantially along said medial side of said shoe upper, beneath said shoe sole, and substantially along said lateral side of said shoe upper, said closure element including a plurality of separated fastening members extending upwards from the lateral component to the instep area of the shoe upper on the lateral side of the shoe upper and a plurality of separated fastening members extending upwards from the medial component to the instep area of the shoe upper on the medial side of the shoe upper;

each said fastening member having a distal end located distal from said base component and proximate the instep area of said shoe upper, said fastening members each having a fastener engaging element located at or immediately adjacent its distal end;

wherein said fastening members on opposing sides of said shoe upper are connected together by a cooperating fastening device coupled to each fastener engaging element to thereby secure said closure element and said shoe upper around the foot of the wearer.

20. The article of footwear of claim 19 wherein each said fastener engaging element includes an aperture for receiving a shoe lace and said cooperating fastening device includes a shoe lace extending through said apertures to thereby secure said shoe upper around the foot of the wearer.

21. The article of footwear of claim 19 wherein said closure element is removably disposed over said shoe upper.

22. The article of footwear of claim 19 wherein said shoe sole includes a midsole layer and an outsole layer, said midsole layer being thinner in an area corresponding to where said overlapping closure element extends along each side of said shoe upper and beneath said shoe sole.

23. The article of footwear of claim 19 wherein said closure element further includes a heel strap, said heel strap extending around a heel region of said shoe upper, each said plurality of fastening members includes a rearmost located fastening member, wherein an upper edge of said heel strap integrally joins a rearward edge of both said rearmost fastening members and wherein a bottom edge of said heel strap integrally joins a rearward edge of each said medial and lateral components of said closure element.

24. The article of footwear of claim 23 wherein said medial and lateral components of said closure element include a plurality of cutout regions therein disposed below said fastening members.

* * * * *